US010364654B2

(12) United States Patent
Andersson et al.

(10) Patent No.: US 10,364,654 B2
(45) Date of Patent: Jul. 30, 2019

(54) INLET-OUTLET SYSTEM AND METHOD FOR SUBSEA STORAGE

(71) Applicant: NOV Subsea Products AS, Asker (NO)

(72) Inventors: Lars Gösta Andersson, Sørumsand (NO); Jan-Otto Reimers, Oslo (NO); Gudmund Roger Totland, Åsgårdstrand (NO); Torleif Engeland Torjussen, Drammen (NO)

(73) Assignee: NOV Subsea Products AS, Asker (NO)

( * ) Notice: Subject to any disclaimer, the term of this patent is extended or adjusted under 35 U.S.C. 154(b) by 186 days.

(21) Appl. No.: 15/540,809

(22) PCT Filed: Jan. 22, 2016

(86) PCT No.: PCT/EP2016/051384
§ 371 (c)(1),
(2) Date: Jun. 29, 2017

(87) PCT Pub. No.: WO2016/116625
PCT Pub. Date: Jul. 28, 2016

(65) Prior Publication Data

US 2018/0016874 A1 Jan. 18, 2018

(30) Foreign Application Priority Data

Jan. 22, 2015 (NO) ..... 20150106

(51) Int. Cl.
*E21B 43/01* (2006.01)
*E21B 41/00* (2006.01)
(Continued)

(52) U.S. Cl.
CPC ..... *E21B 41/0007* (2013.01); *B65D 88/78* (2013.01); *E21B 43/01* (2013.01);
(Continued)

(58) Field of Classification Search
CPC ..... E21B 41/0007; E21B 43/01; E21B 43/08; E21B 43/101; E21B 43/36; B65D 88/78
See application file for complete search history.

(56) References Cited

U.S. PATENT DOCUMENTS 3,257,036 A 6/1966 Micallef
3,658,080 A 4/1972 Mitchell
(Continued)

FOREIGN PATENT DOCUMENTS

EP 1 396 288 3/2004
GB 2499804 9/2013
(Continued)

OTHER PUBLICATIONS

International Search Report and Written Opinion of the International Searching Authority dated Mar. 29, 2016 in International Application No. PCT/EP2016/051384.
(Continued)

*Primary Examiner* — Nicolas A Arnett
(74) *Attorney, Agent, or Firm* — Wenderoth, Lind & Ponack, L.L.P.

(57) ABSTRACT

A system for emptying a gravity separated crude oil including a flexible bag storing the crude oil arranged within a protection structure, the protection structure including a bottom element forming the lower section of the protection structure, the flexible bag being connected to a flange that is connected to the protection structure, and includes at least one fluid conduit providing fluid communication between the flexible bag and outside the protection structure. A first outlet pipe is arranged inside the flexible bag near the bottom element and is connected to and in fluid communication with the at least one fluid conduit. A perforated tube surrounding the outlet pipe provides an annulus fluid passage, water is supplied to the structure volume, and the crude oil is emptied through the at least one fluid conduit, through the perfora-
(Continued)

tions in the perforated tube, through the annulus fluid passage to the first outlet pipe.

18 Claims, 5 Drawing Sheets

(51) Int. Cl.

| | |
|---|---|
| ***E21B 43/36*** | (2006.01) |
| ***B65D 88/78*** | (2006.01) |
| *E21B 43/08* | (2006.01) |
| *E21B 43/10* | (2006.01) |

(52) U.S. Cl.
CPC ..... *E21B 43/36* (2013.01); *E21B 43/08* (2013.01); *E21B 43/101* (2013.01)

(56) References Cited

U.S. PATENT DOCUMENTS

| | | | | |
|---|---|---|---|---|
| 4,190,072 | A | 2/1980 | Fernandez | |
| 4,556,343 | A | 12/1985 | Cheung | |
| 9,540,169 | B1 * | 1/2017 | Krohn | B65D 88/78 |
| 2010/0096120 | A1 * | 4/2010 | Ayasse | E21B 43/08 166/55.1 |
| 2012/0211234 | A1 * | 8/2012 | Wilie | E21B 43/0122 166/345 |
| 2013/0112284 | A1 | 5/2013 | Hasunuma | |
| 2014/0356068 | A1 * | 12/2014 | Andritsos | B63C 7/006 405/60 |
| 2016/0319652 | A1 * | 11/2016 | Kalli | E21B 43/36 |
| 2017/0037716 | A1 * | 2/2017 | Kohlik | E21B 43/24 |
| 2018/0179878 | A1 * | 6/2018 | Sund | B01D 21/2494 |

FOREIGN PATENT DOCUMENTS

| | | |
|---|---|---|
| NO | 19975479 | 5/1999 |
| WO | 2004/037681 | 5/2004 |
| WO | 2010/089317 | 8/2010 |

OTHER PUBLICATIONS

International Preliminary Report on Patentability dated May 2, 2017 in International Application No. PCT/EP2016/051384.

Written Opinion on the International Preliminary Examining Authority dated Dec. 21, 2016 in International Application No. PCT/EP2016/051384.

Search Report dated Aug. 20, 2015 in Norwegian Patent Application No. 2150106.

* cited by examiner

INLET-OUTLET SYSTEM AND METHOD FOR SUBSEA STORAGE

The present invention relates to a method for emptying a gravity separated crude oil from a storage system, an inlet-outlet system for a storage system comprising a flexible bag for storing a fluid arranged inside a protection structure and a flexible bag element.

BACKGROUND

Within the offshore oil and gas recovery industry the possibility to store fluids such as crude oil, chemicals, produced water on the sea bottom provides a huge increase in available storing space compared to storing on platforms and a more stable storing environment compared to storing on vessels such as FPSO's (Floating production storage and off loading). The subsea storage with a flexible storage bag within a protection structure surrounding the bag is a promising solution to make use of this possibility in a safe way. Subsea storing also plays a part in the possibility of providing an oil and/or gas recovery plant fully installed subsea with no offshore top side installations except from a buoy.

Also in other storing systems, not necessarily arranged subsea, it may in some situations be advantages to employ a flexible bag arranged within an outer protection structure. Such situations include storing in vessels or platforms where a first fluid is stored in the flexible bag and the flexible bag is surrounded by a second fluid.

When storing none pure fluids the storing of an initial homogeneous fluid may over time result in separation of the different components, for instance due to density differences, also changes in temperature may result in formation of an inhomogeneous fluid. In some situations one may also wish to store an inhomogeneous fluid. In all these situations there is a desire to be able to fully empty the storage without risking a build up of one component in a rest volume of the storage after several circles of filling and emptying.

PRIOR ART

NO19975479 discloses a subsea tank for drilling fluid comprising a flexible bag for storing the drilling fluid with in tank. The inlet and outlet to the flexible bag consist of a perforated pipe arranged in a lower section of the flexible bag.

WO2004/037681 discloses a subsea located storage for crude oil comprising a flexible balloon arranged within an external casing. The flexible balloon is attached to a hatch. The balloon can be installed in the casing via an opening in the top of the casing. The hatch is connected to the casing in the area surrounding the opening. Two pipelines for filling and emptying the storage are arranged in the hatch and bring external pipelines in fluid communication with the interior of the flexible balloon. The openings of the two pipelines inside the balloon are arranged just below the hatch in the upper part of the balloon.

Should water separate out from the crude oil stored in the bag, the water will due to the higher density be concentrated at the bottom of the bag. When the oil is discharged from the bag at least part of the water is likely to remain in the lowest part of the bag and not get in contact with the outlet pipe. Although the bag is flexible and collapses when it is emptied the size and configuration of the bag is likely to result in creases or folds wherein high density fluid is likely to be trapped.

Further when the flexible bag is emptied the bag will collapse around the outlet pipe. The excess bag material may cover the opening on the outlet thereby restricting the further emptying of the bag.

U.S. Pat. No. 3,658,080 discloses an arrangement for modifying a surface tank or underground tank to hold more than a single liquid by inserting a flexible bag therein. A fill pipe provided with a plurality of holes spaced through out the length thereof is arranged within the flexible bag. An open ended pipe is arranged within the fill pipe. Withdrawing liquid from the bag will cause the bag to sag to the bottom.

US2013/0112284 discloses an outer container with an inner liner for storing liquid, where the liquid is pushed out from the liner by gas pressure introduced in the outer container. A siphon with an outer concentric drop tube is arranged inside the liner. Through holes at an equal pitch are formed in the wall of the drop tube. The tube serves as a liquid flow passage from the through holes to an outlet opening at the end of the siphon. The flow passage avoids the formation of liquid balls that can not be removed form the liner.

OBJECTIVES OF THE INVENTION

The objective of the present invention is to provide an outlet system for a flexible storage bag that secures full emptying of the bag. Especially, an object is providing an outlet system and method that secures emptying of any high density fluid concentrated on the bottom of the flexible bag due to gravity separation taking place within the flexible bag.

A further objective is to provide a system and method that allows for controlled emptying of a flexible bag such that the amount high density fluid removed from the flexible bag together with fluid of lower density is regulated to controlled the composition of the fluid being removed.

A further objective is to provide an outlet system where the collapsing of the bag has limited effect on the flow out of the bag.

A further object is in one aspect to provide a system that provides increased control of the folding pattern of a collapsing flexible bag.

The present invention provides a method for emptying a gravity separated crude oil from a storage system comprising a flexible bag for storing the crude oil, wherein the flexible bag is arranged within a protection structure with a structure volume, wherein the protection structure comprises a bottom element forming the lower section of the protection structure, the flexible bag is connected to a flange, wherein the flange is connected to the protection structure, the flange comprises at least one fluid conduit providing fluid communication between a storage volume inside the flexible bag and a position outside the protection structure, wherein the method comprises

- providing a first outlet pipe with an opening arranged inside the flexible bag near the bottom element wherein the first outlet pipe is connected to and in fluid communication with the at least one fluid conduit,
- providing a perforated tube surrounding the outlet pipe providing an annulus fluid passage,
- supplying water to the structure volume, and
- emptying the crude oil from the storage volume through the at least one fluid conduit by allowing the crude oil to flow through the perforations in the perforated tube, through the annulus fluid passage to the opening of the first outlet pipe, thereby securing removal of a crude oil phase gravity separated within the flexible bag.

In one aspect of the method the storage system comprises one or more second outlet pipe(s) is arranged within the perforated tube, wherein the second outlet pipe comprises an opening at a different level than the opening of the first outlet pipe, and wherein the method comprises selecting the amount of crude oil removed from each outlet pipe.

In a further aspect the one or more second outlet pipe(s) is arranged parallel with the first outlet pipe in the annulus between the first outlet pipe and the perforated tube.

In a further aspect the method comprises mixing the fluid removed from each outlet pipe thereby controlling the composition of the mixed fluid. Due to gravity separation the crude oil stored may have separated into crude oil phases, such as oil phase, a water phase and a particle phase. However, also the oil med gravity separated to lighter and heavier oil phases. The fluid removed through the outlets at different levels is a crude oil phase but may not necessarily contain crude oil.

In another aspect the method comprises selective removal of the gravity separated crude oil from the different levels.

In a further aspect of the method the perforated tube comprises asymmetric perforations over the length of the tube providing a larger inflow area in the upper half of the tube near the flange compared to the lower half of the perforated tube, wherein the method comprises maintaining a high flow of crude oil out of the flexible bag.

The present invention further provides a storage system comprising a flexible bag for storing a fluid, wherein the flexible bag is arranged within a protection structure with a structure volume, wherein the protection structure comprises a bottom element forming the lower section of the protection structure, the flexible bag is connected to a flange, wherein the flange is connected to the protection structure, the flange comprises at least one fluid conduit providing fluid communication between a storage volume inside the flexible bag and a position outside the protection structure, characterised in that the storage system comprises a first outlet pipe with an opening arranged inside the flexible bag near the bottom element wherein the first outlet pipe is connected to and in fluid communication with the at least one fluid conduit and a perforated tube surrounding the outlet pipe providing an annulus fluid passage, such that fluid when being removed from the storage volume can flow through perforations in the perforated tube, through the annulus fluid passage to the opening of the first outlet pipe and through the outlet pipe to the at least one fluid conduit, wherein the perforated tube comprises asymmetric perforations over the length of the tube providing a larger inflow area in the upper half of the tube near the flange compared to the lower half of the perforated tube, wherein the method comprises maintaining a high flow of crude oil out of the flexible bag.

The opening of the outlet pipe is arranged at or near end of the outlet pipe opposite the end of the outlet pipe connected to the flange.

In one aspect of the storage system the protection structure comprises at least one opening either connectable to the open sea or to a pipeline for transferring fluid in and out of the structure volume. If the storage system is arranged subsea sea water may travel in and out of the protection structure providing a water pressure on the outside of the flexible bag that will provide for emptying and collapsing of the bag when the fluid stored in the flexible bag is allowed to flow out of the fluid conduit and into a transfer pipe connected thereto. The same effect can be obtained if the protection structure is closed and fluid is transferred into the structure volume via the opening in the structure.

The perforated tube comprises asymmetric perforations over the length of the tube. The flow through the perforations will be restricted if the flexible bag collapses and the bag material covers and thereby blocks the perforations. To maintain a high flow in the annulus and through the opening of the outlet pipe the areal of perforations that are not blocked by bag material should be kept high. In one aspect the perforated tube comprises asymmetric perforations over the length of the tube providing a larger inflow area in the upper half of the tube near the flange compared to the lower half of the perforated tube. The inflow area is the areal of the perforations. In a further aspect the perforated tube may have an increased diameter near the flange to provide for an increased inflow area in this part of the perforated tube.

In a further aspect of the storage system the bottom element comprises a top surface facing the structure volume, and wherein the top surface is inclined towards the opening of the outlet pipe. In this aspect the force of gravity is employed to secure that the fluid in the storage volume flows towards the opening in the outlet pipe as the surface is inclined towards the position of the opening. This aspect further facilitates the emptying of the fluid with the highest density from the flexible bag.

In another aspect of the storage system the flexible bag is connected to the perforated tube in proximity of the opening of the first outlet pipe. This aspects provides for increased control of the position of the outlet pipe in relation to the flexible bag In a further aspect the flexible bag comprises a connection element on the outside thereof for connecting the flexible bag to the bottom element. The connection element is preferable releasable connectable to the bottom element so that when the flexible bag is arranged in the protection structure the position of the opening of the outlet pipe in relation to the protection structure is fixed. In another aspect the connection element comprises a fluid passage in fluid communication with the storage volume. The fluid passage may be controllably opened and closed and arranged in fluid communication with a pipeline thereby allowing for inlet and/or outlet of fluid to and from the flexible storage bag.

In yet another aspect the storage system further comprises one or more second outlet pipe(s) arranged within the perforated tube, wherein the second outlet pipe comprises an opening at a different level than the opening of the first outlet pipe.

In another aspect the one or more second outlet pipe(s) is arranged parallel with the first outlet pipe in the annulus between the first outlet pipe and the perforated tube.

Further the present invention provides a flexible bag element for a storage system, wherein the flexible bag element comprises a flexible bag for storing a fluid and a flange, wherein the flexible bag is connected to the flange, wherein the flange is connectable to a protection structure of a storage system, wherein the flange comprises at least one fluid conduit providing fluid communication between a storage volume inside the flexible bag and a position outside the protection structure when the flange is connected thereto, characterised in that the flexible bag element comprises a first outlet pipe with an opening arranged inside the flexible bag wherein the first outlet pipe is connected to and in fluid communication with the at least one fluid conduit and a perforated tube surrounding the outlet pipe providing an annulus fluid passage, wherein the perforated tube is connected to the flange such that fluid when being removed from the storage volume can flow through perforations in the perforated tube, through the annulus fluid passage to the opening of the first outlet pipe and through the outlet pipe to the at least one fluid conduit.

In one aspect of the flexible bag element the perforated tube is at one end thereof connected to the flange and is at the opposite end connected to the flexible bag.

In a further aspect of the flexible bag element flexible bag is folded around the perforated tube. When folded around the perforated tube the diameter of the bag element is limited and adapted to being placed in a protection structure through and opening therein.

In another aspect the flexible bag element comprises a connection element on the outside of the flexible bag for connecting the flexible bag to a bottom element of a protection structure. The connection element is preferably arranged opposite the flange.

In yet another aspect the flexible bag element comprises one or more second outlet pipe arranged within the perforated tube, wherein each of the one or more second outlet pipes comprises an opening at a different position than the opening of the first outlet pipe. Each of the second outlet pipes may be arranged for being in fluid communication with separate fluid transfer pipelines.

In another aspect the one or more second outlet pipe(s) is arranged parallel with the first outlet pipe in the annulus between the first outlet pipe and the perforated tube.

In a further aspect of the flexible bag element the perforated tube and the first outlet pipe extends across a considerable part of the diameter of the storage volume, preferably more than 50%, more preferably more than 75% of the diameter.

In other aspects of the flexible bag element the perforated tube may be configured with asymmetric perforations over the length of the tube. The flow through the perforations will be restricted if the flexible bag collapses and the bag material covers and thereby blocks the perforations. To maintain a high flow in the annulus and through the opening of the outlet pipe the areal of perforations that are not blocked by bag material should be kept high. In one aspect the perforated tube comprises asymmetric perforations over the length of the tube providing a larger inflow area in the upper half of the tube near the flange compared to the lower half of the perforated tube. The inflow area is the areal of the perforations. In a further aspect the perforated tube may have an increased diameter near the flange to provide for an increased inflow area in this part of the perforated tube.

The term "outlet" as used herein when referring to the outlet system according to the present invention refers to a fluid communication path from the internal volume of the flexible storage bag to a position external of the storage system for emptying the flexible storage bag. The outlet may however also include additional functions such as function as an inlet for providing fluid via the fluid communication path into the internal volume of the flexible bag, or controlling the position of the flexible bag within the protection structure.

The term "protection structure" as used herein refers to a closed or open tank structure surrounding the flexible bag. The protection structure can be both closed and open to the surroundings.

The term "lower" and the term "bottom" as used herein refers to a position with reference to the direction of the force of gravity.

The term "crude oil" as used herein refers to any grade of crude oil or condensate which during storage may be at least partly gravity separated, such that fractions with higher density including but not limited to sand particles and water are concentrated in lower section.

The term "water" as used here refers to any type of water including sea water, fresh water, produced water etc.

BRIEF DESCRIPTION OF THE DRAWINGS

The present invention will be described in further detail with reference to the enclosed drawings illustrating embodiments thereof.

PRINCIPAL DESCRIPTION OF THE INVENTION

Figure 1:
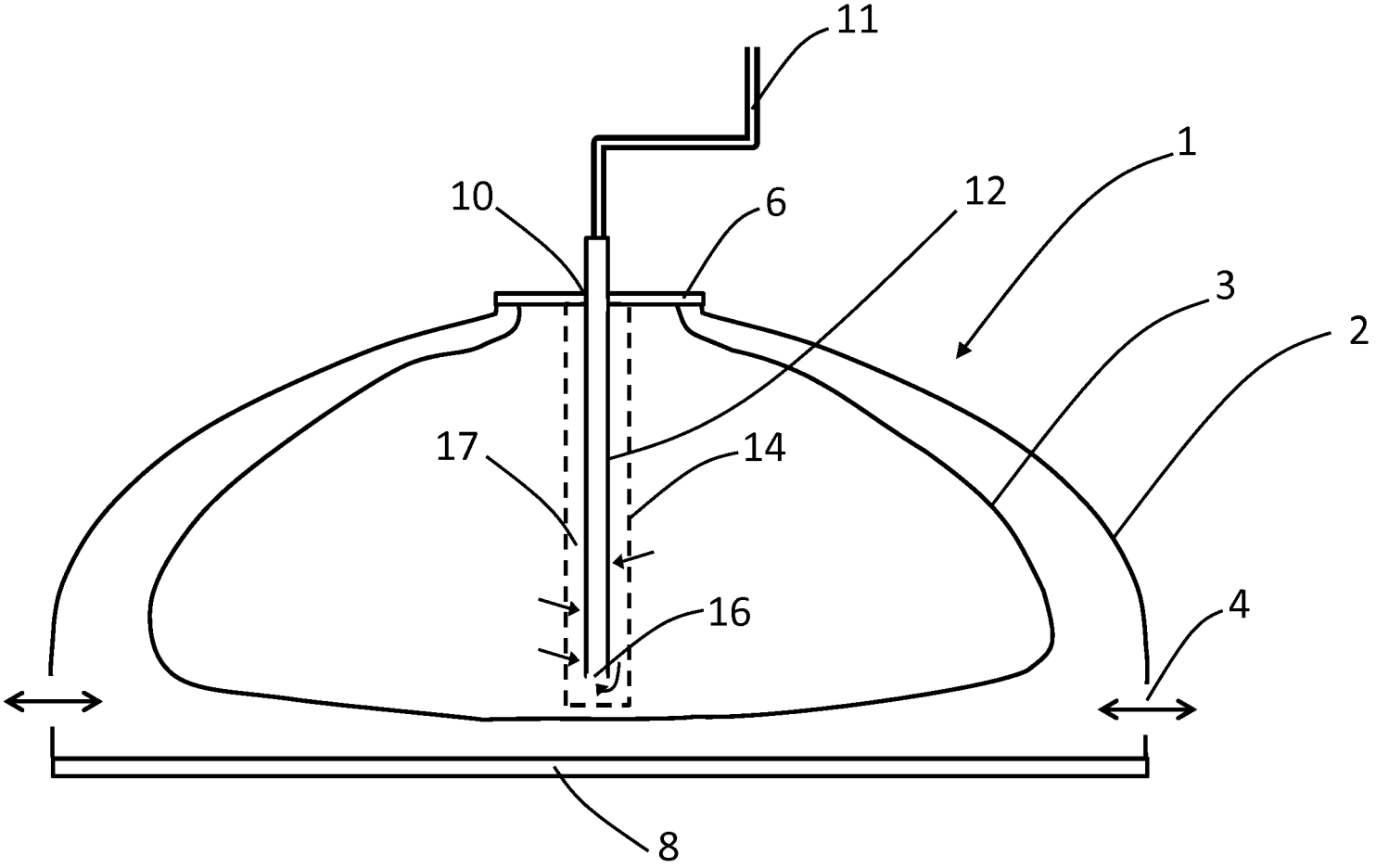
FIG. 1 schematically illustrates a cross sectional view of an embodiment of the outlet system according to the present invention.

The present invention will now be described in further detail with reference to the enclosed figures. A person skilled in the art will understand the figures are schematic illustrations of the principles of the invention and that the invention can be utilized together with other storage solutions than the ones visible in the drawings. A person skilled in the art will also appreciate that the different embodiments of the present invention may be freely combined.

FIG. 1 provides a cross sectional view of a first embodiment of a subsea storage system 1 comprising a flexible storage bag 3 arranged within a protection structure 2. The flexible bag 3 is connected to a flange 6 connected to the protection structure 2. The connection between the flexible bag and the flange is preferably fluid tight so that the storage volume within the flexible bag is not in fluid communication with a structure volume within the protection structure. The flange may form part of a hatch for accessing the internal side of the protection structure. The flange comprises a fluid conduit 10 connecting the storage volume of the flexible bag with a position outside the protection structure. The fluid conduit can be connected to a pipeline 11 leading to a topside location such as an on-shore installation, another subsea installation, a platform, a buoy or a vessel.

Seawater surrounding the subsea storage system can in the illustrated embodiment enter and leave the protection structure freely trough the opening 4 in the protection structure. The present invention is focused on providing an outlet system for this storage system which secures that the flexible bag 3 can be fully emptied including any substances like sand, particles or water that may accumulate in the bottom of the flexible bag 3 when fluids such as crude oil is stored in the flexible bag over a period of time. The storage system comprises a first outlet pipe 12 connected to the fluid conduit 10 and expanding from the flange 6 into the flexible bag. The outlet pipe 12 comprises an opening 16 preferable arranged near or in proximity of a bottom element 8 of the protection structure. Surrounding the outlet pipe 12 a perforated tube 14 is arranged forming an annulus 17. In the illustrated embodiment the perforated tube 14 surrounds the free end of the outlet pipe 12. The arrows indicate the flow of fluid when the flexible bag is being emptied. The stored fluid flows through the perforations in the perforated tube into the annulus 17. In the annulus the fluid floes down to the opening 16 in the outlet pipe 12. Then the fluid flows up through the outlet pipe 12, through the fluid conduit 10 and further through the pipeline 11. This pipe in tube outlet system secures that any fluid accumulating in the bottom section of the flexible bag will be transported out of the flexible bag. Fluid positioned in higher levels will also flow in through the perforations and trough the annulus to the opening 16 in the lower section of the protection structure.

Figure 2:
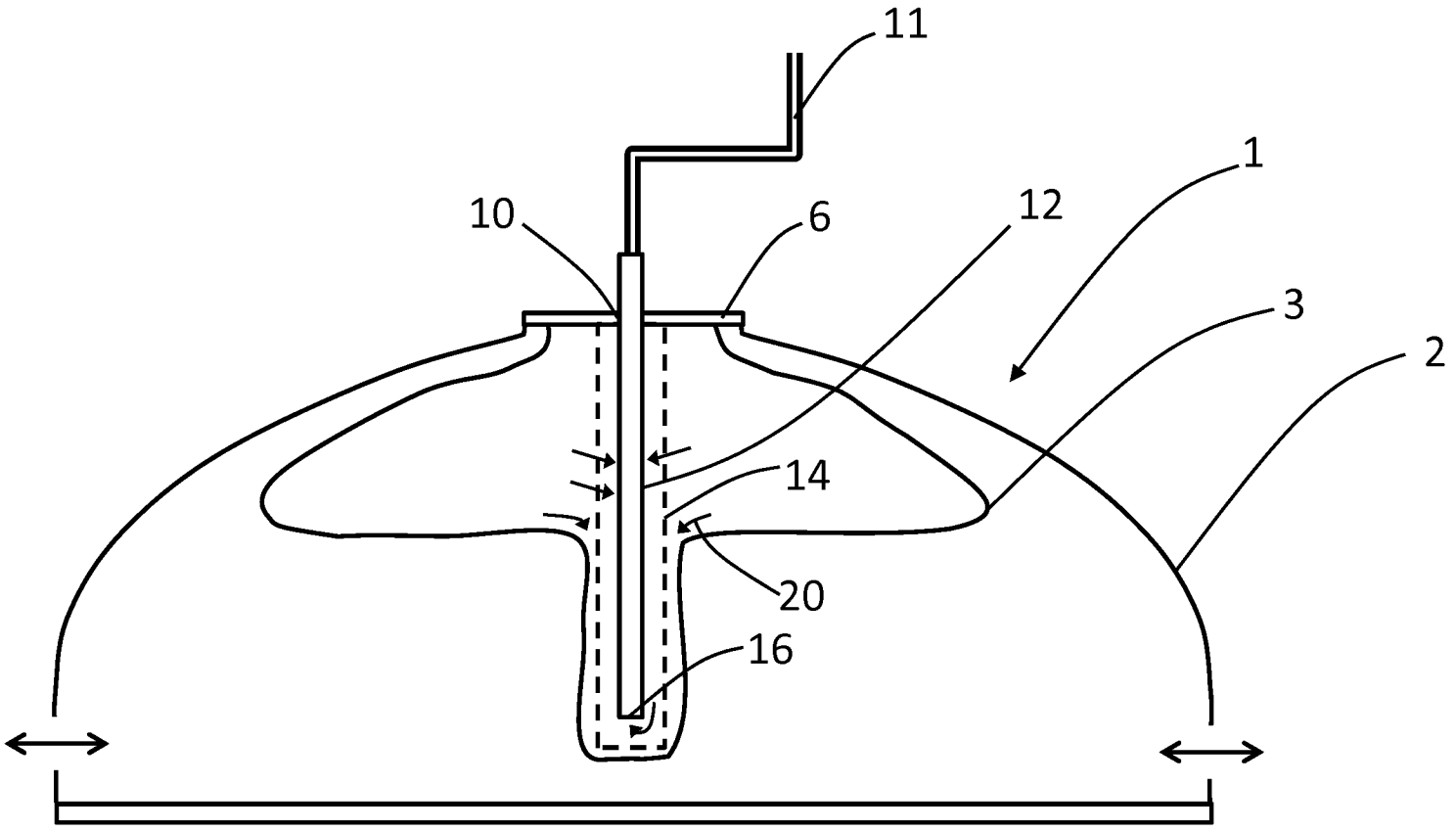
FIG. 2 schematically illustrates a cross sectional view of the embodiment on FIG. 1 during emptying.

FIG. 2 illustrates the situation wherein a part of the fluid stored in the flexible bag illustrated in FIG. 1 has been emptied out through the pipeline 11. The fluid stored in the flexible bag has a lower density than the surrounding seawater and can for instance be crude oil. Due to the lower density the remaining fluid in the flexible will occupy mainly the upper section of the flexible bag. The water pressure from the outside of the bag combined with the flow of fluid out of the flexible bag results in the bag being folded around the lower end of the perforated tube 14. The bag material when folded around part of the perforated tube is likely to at least partly block some of the perforations. However as the tube 14 comprises perforations along at least large sections of its longitudinal extent the fluid will continue to be able to flow into the perforations in the sections not blocked by the bag material. The arrows 20 indicate the flow of stored fluid. Due to the positioning of the opening 16 in the lowest section of the flexible bag any high density fluid that may separate out from the stored fluid will by the help of gravity be transported to the lowest section of the flexible bag and from there be emptied out of the bag through the outlet pipe 12.

Figure 3:
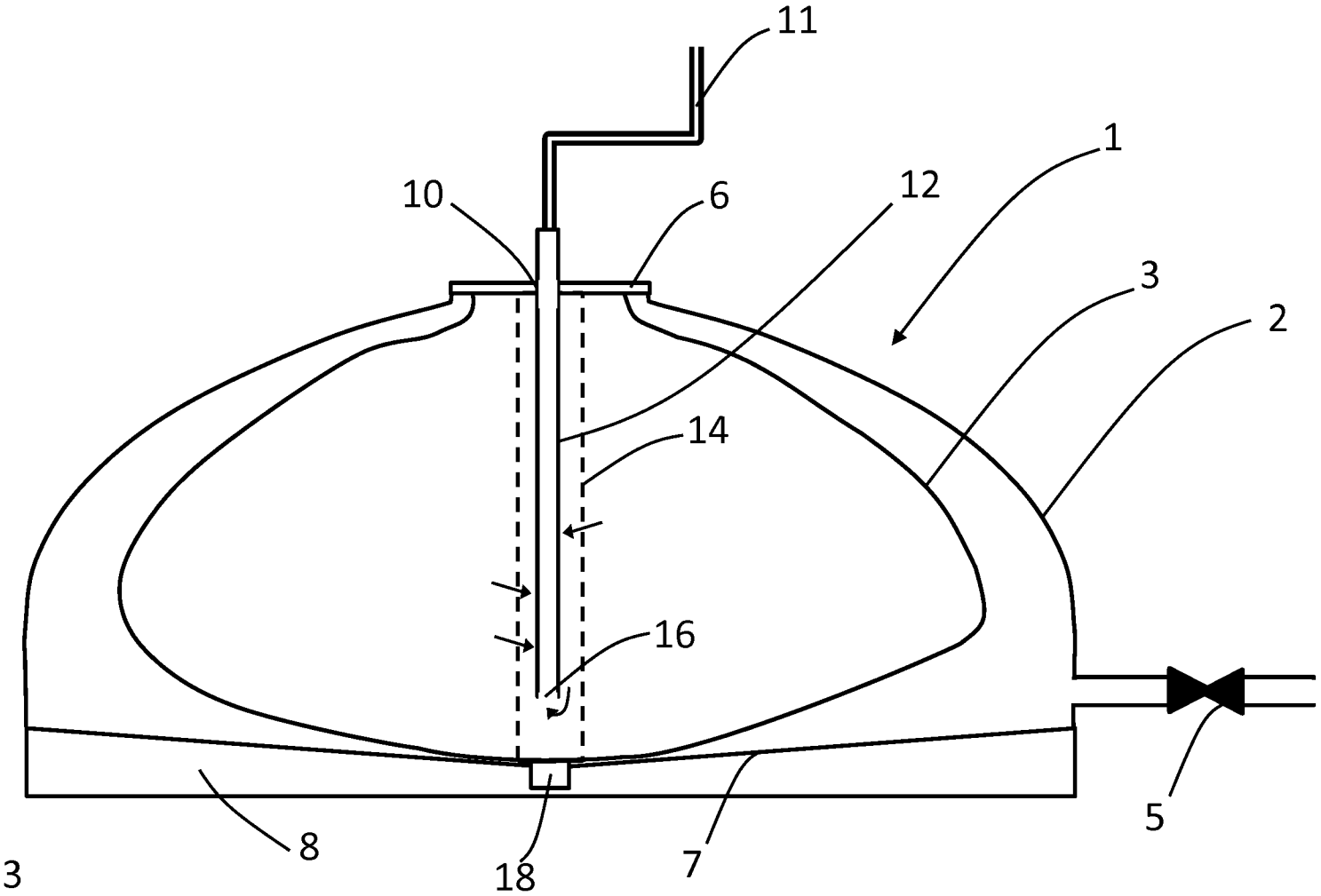
FIG. 3 schematically illustrates a cross sectional view of another embodiment of the outlet system according to the present invention.

FIG. 3 illustrates an alternative embodiment of the present invention wherein the inlet and outlet of fluid to the structure volume is controllable by the opening and closing of the valve 5. This embodiment can be combined with the embodiment illustrates on the FIGS. 1 and 2. Further in the illustrated embodiment the bottom element 8 comprises a top surface 7 towards the structure volume and the flexible bag 3. The top surface 7 is inclined towards the position of the opening 16 in the outlet pipe 12. Also illustrated on FIG. 3 is a connection element 18 fastened to the outside of the flexible bag 3 opposite the flange 6 and optionally fastened to the wall of the bag opposite a fastening of the perforated tube 4 to the inside of the bag near the opening 16 of the first outlet pipe. The bottom element 8 comprises reception means adapted to releasable receive and connect the connection element 18 to the bottom element 8. The top surface 7 is inclined towards the reception means.

The connection element 18 can have any suitable form for establishing a preferably releasable connection between the flexible bag and the bottom element thereby providing for increased control of the positioning of the flexible bag within the protection structure and positioning of the opening in the outlet pipe with respect to the inclined top surface of the bottom element.

Figure 4:
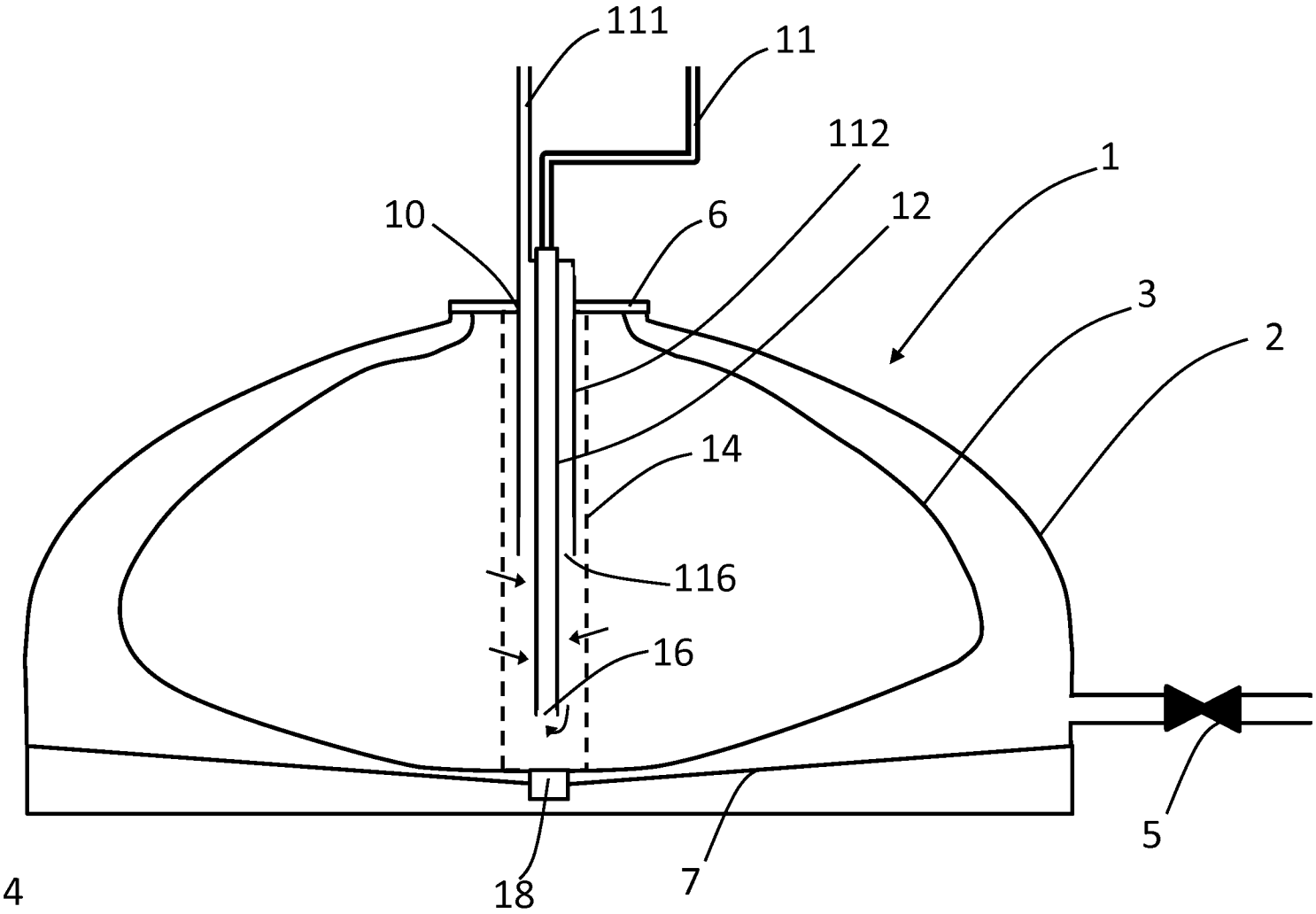
FIG. 4 schematically illustrates a cross sectional view of a further embodiment of the outlet system according to the present invention.

FIG. 4 illustrates an alternative embodiment similar to the embodiment illustrated on FIG. 3 but comprising a second outlet pipe 112 in fluid communication with a second pipeline 111. The opening of the second outlet pipe 116 is at a different level in the flexible bag than the opening 16 of the first outlet pipe. The second outlet pipe is arranged in the annulus between the first outlet pipe 12 and the perforated tube 14. In the illustrated embodiment the second outlet pipe 112 surrounds a section of the first outlet pipe 12 but it is equally possible to arrange the two or more outlet pipes independently within the perforated tube 14. By including more than one outlet pipe it is possible to empty different fractions of the fluid separated out by gravity selectively If for instance the fluid is crude oil that has been kept in the storage for sufficient time to result in an accumulation of water in the lower section the fraction removed through opening 16 will have a higher water content then the fraction removed trough opening 116 and as the fractions are obtained separately they can be treated separately if needed.

Figure 5:
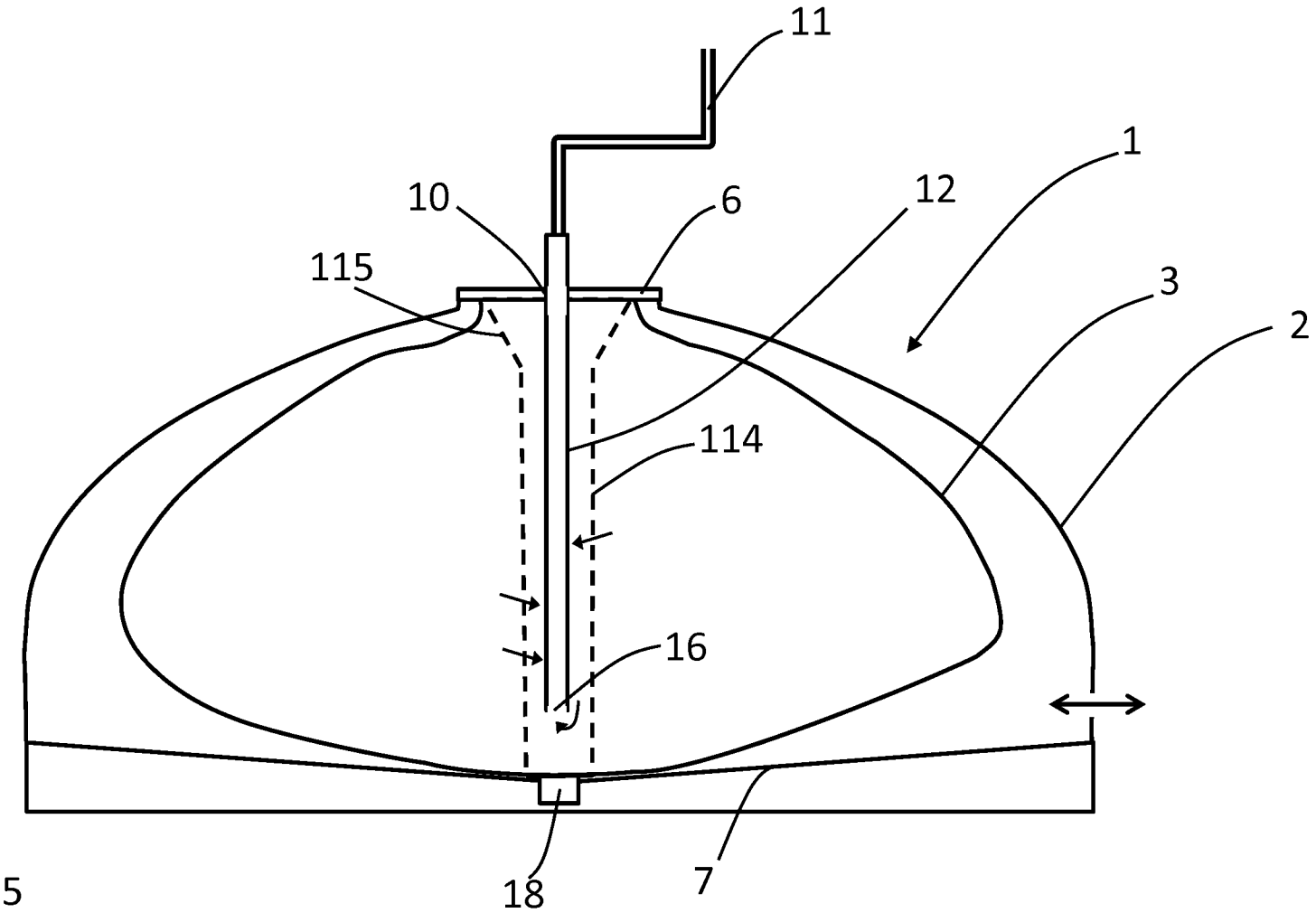
FIG. 5 schematically illustrates a cross sectional view of yet another embodiment of the outlet system according to the present invention.

FIG. 5 illustrates a further embodiment of the present invention wherein the perforated tube 114 in the upper section 115 closest to the flange 6 has an increased diameter thereby providing an increased surface area allowing for increasing the area of the perforations such that the flow into the annular passage can be maintained also when the flow through a larger fraction of the perforations in the lower section is blocked by sections of the collapsed flexible bag.

The invention claimed is:

1. Method for emptying a gravity separated crude oil from a storage system comprising a flexible bag for storing the crude oil, wherein the flexible bag is arranged within a protection structure with a structure volume, wherein the protection structure comprises a bottom element forming the lower section of the protection structure, the flexible bag is connected to a flange, wherein the flange is connected to the protection structure, the flange comprises at least one fluid conduit providing fluid communication between a storage volume inside the flexible bag and a position outside the protection structure, characterised in that the method comprises providing a first outlet pipe with an opening arranged inside the flexible bag near the bottom element wherein the first outlet pipe is connected to and in fluid communication with the at least one fluid conduit, providing a perforated tube surrounding the outlet pipe providing an annulus fluid passage, supplying water to the structure volume, and emptying the crude oil from the storage volume through the at least one fluid conduit by allowing the crude oil to flow through the perforations in the perforated tube, through the annulus fluid passage to the opening of the first outlet pipe, thereby securing removal of a crude oil phase gravity separated within the flexible bag.

2. Method according to claim 1, wherein the storage system comprises one or more second outlet pipe(s) arranged within the perforated tube, wherein the second outlet pipe comprises an opening at a different level than the opening of the first outlet pipe, and wherein the method comprises selecting the amount of crude oil removed from each outlet pipe.

3. Method according to claim 2, wherein the method comprises mixing the fluid removed from each outlet pipe thereby controlling the composition of the mixed fluid.

4. Method according to claim 2, wherein the method comprises selective removal of the gravity separated crude oil from the different levels.

5. Method according to claim 1, wherein the perforated tube comprises asymmetric perforations over the length of the tube providing a larger inflow area in the upper half of the tube near the flange compared to the lower half of the perforated tube, wherein the method comprises maintaining a high flow of crude oil out of the flexible bag.

6. Storage system comprising a flexible bag for storing a fluid, where the flexible bag is arranged within a protection structure with a structure volume, wherein the protection structure comprises a bottom element forming the lower section of the protection structure, the flexible bag is connected to a flange, wherein the flange is connected to the protection structure, the flange comprises at least one fluid conduit providing fluid communication between a storage volume inside the flexible bag and a position outside the protection structure, characterised in that the storage system comprises a first outlet pipe with an opening arranged inside the flexible bag near the bottom element wherein the first outlet pipe is connected to and in fluid communication with the at least one fluid conduit and a perforated tube surrounding the outlet pipe providing an annulus fluid passage, such that fluid when being removed from the storage volume can flow through perforations in the perforated tube, through the annulus fluid passage to the opening of the first outlet pipe and through the outlet pipe to the at least one fluid conduit, wherein the perforated tube comprises asymmetric perforations over the length of the tube providing a larger inflow area in the upper half of the tube near the flange compared to the lower half of the perforated tube.

7. Storage system according to claim 6, wherein the protection structure comprises at least one opening either connectable to the open sea or to a pipeline for transferring fluid in and out of the structure volume.

8. Storage system according to claim 6, wherein the bottom element comprises a top surface facing the structure volume, and wherein the top surface is inclined towards the opening of the outlet pipe.

9. Storage system according to claim 6, wherein the flexible bag is connected to the perforated tube in proximity of the opening of the first outlet pipe.

10. Storage system according to claim 9, wherein the flexible bag comprises a connection element on the outside thereof for connecting the flexible bag to the bottom element.

11. Storage system according to claim 10, wherein the connection element comprises a fluid passage in fluid communication with the storage volume.

12. Storage system according to claim 6, wherein one or more second outlet pipe(s) is arranged within the perforated tube, wherein the second outlet pipe comprises an opening at a different level than the opening of the first outlet pipe.

13. Flexible bag element for a storage system, wherein the flexible bag element comprises a flexible bag for storing a fluid and a flange, wherein the flexible bag is connected to the flange, wherein the flange is connectable to a protection structure of a storage system, wherein the flange comprises at least one fluid conduit providing fluid communication between a storage volume inside the flexible bag and a position outside the protection structure when the flange is connected thereto, characterised in that the flexible bag element comprises a first outlet pipe with an opening arranged inside the flexible bag wherein the first outlet pipe is connected to and in fluid communication with the at least one fluid conduit and a perforated tube surrounding the outlet pipe providing an annulus fluid passage, wherein the perforated tube is connected to the flange such that fluid when being removed from the storage volume can flow through perforations in the perforated tube, through the annulus fluid passage to the opening of the first outlet pipe and through the outlet pipe to the at least one fluid conduit, wherein the perforated tube comprises asymmetric perforations over the length of the tube providing a larger inflow area in the upper half of the tube near the flange compared to the lower half of the perforated tube.

14. Flexible bag element according to claim 13, wherein the perforated tube at one end is connected to the flange and at the opposite end is connected to the flexible bag.

15. Flexible bag element according to claim 13, wherein the flexible bag is folded around the perforated tube.

16. Flexible bag element according to claim 13, wherein the flexible bag element comprises a connection element on the outside of the flexible bag for connecting the flexible bag to a bottom element of a protection structure opposite the flange.

17. Flexible bag element according to claim 13, wherein the flexible bag element comprises one or more second outlet pipe arranged within the perforated tube, wherein the one or more second outlet pipe comprises an opening at a different position than the opening of the first outlet pipe.

18. Flexible bag element according to claim 13, wherein the perforated tube and the first outlet pipe extends across more than 50% of the diameter of the storage volume.

* * * * *